US008348385B2

(12) United States Patent
Benjamin et al.

(10) Patent No.: US 8,348,385 B2
(45) Date of Patent: Jan. 8, 2013

(54) PRINTHEAD DIE

(75) Inventors: Trudy Benjamin, Portland, OR (US); Joseph M. Torgerson, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 84 days.

(21) Appl. No.: 13/149,014

(22) Filed: May 31, 2011

(65) Prior Publication Data

US 2012/0306968 A1 Dec. 6, 2012

(51) Int. Cl.
*B41J 2/145* (2006.01)
*B41J 2/15* (2006.01)

(52) U.S. Cl. ..... 347/40; 347/49; 347/50

(58) Field of Classification Search ..... 347/15, 347/20, 40, 42, 43, 47, 49, 50, 67
See application file for complete search history.

(56) References Cited

U.S. PATENT DOCUMENTS 6,350,013 B1 * 2/2002 Scheffelin et al. ..... 347/49
7,384,128 B2 * 6/2008 Sheahan et al. ..... 347/42

* cited by examiner

*Primary Examiner* — Thinh Nguyen

(57) ABSTRACT

A printhead die that includes first and second slots through the die for feeding a same liquid, the slots offset from each other along two axes. The die has a first nozzle package adjacent one side of the first slot and extending toward the second slot along the minor axis. The die includes a second nozzle package adjacent an opposite side of the second slot and extending toward the first slot along the minor axis. The first and second nozzle packages each have a slanted corner profile.

20 Claims, 7 Drawing Sheets

PRINTHEAD DIE

BACKGROUND

Inkjet printheads are widely used in printing mechanisms today. Those mechanisms, in turn, go into many products such desktop printers, portable printers, plotters, copiers, camera printers, transaction printers, video printers, point-of-sale terminals, facsimile machines, and all-in-one devices (e.g. a combination of at least two of a printer, scanner, copier, and fax), to name a few.

Printheads typically have a number of liquid ejection elements, often referred to as "nozzles", that are arranged in a linear orientation having a particular length along the major axis of the linear array. This length is sometimes referred to as the "height" of the printhead, although the printhead can be orientated in any direction. Drops are deposited on a print medium, such as paper, as the printhead, the paper, or both are moved relative to each other. In products in which the length of the printhead along the major axis is much less than the size of both dimensions of the medium, movement of the medium relative to the printhead in one dimension may be coordinated with reciprocation of the printhead relative to the medium in an orthogonal direction in order to allow drops of the liquid to be deposited on the entire printable area of the medium.

Such reciprocation, however, reduces the throughput of the printing. Using a printhead, or an array of printheads, having a height at least as large as one dimension of the medium can improve printing throughput by eliminating the time associated with reciprocation of the printhead.

The printhead also has a "width", or a length in a direction of the minor axis of the linear array, a direction that is orthogonal to the height of the column of nozzles. In general, the wider the printhead for a given length, the larger the area of the printhead, and the higher the cost of the printhead.

DETAILED DESCRIPTION

Figure 1:
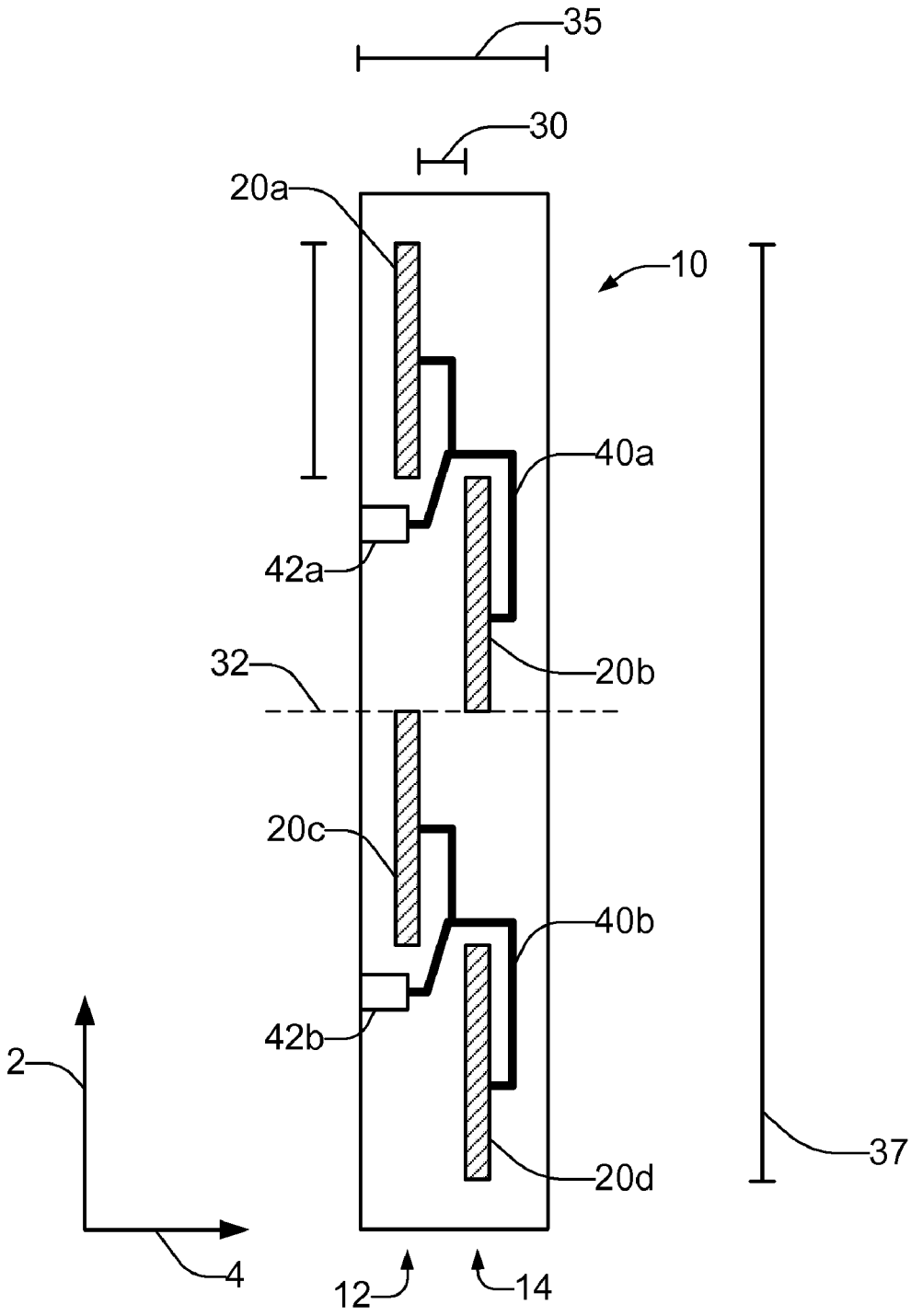
FIG. 1 is a schematic representation of a printhead die for emitting drops of a particular liquid, in accordance with an embodiment of the present disclosure.

Inkjet printheads are typically fabricated on a substrate, such as a silicon die, using integrated circuit and/or micromachining fabrication techniques. The nozzles are typically disposed on either side of an ink feed slot that is formed completely through the die. The slot feeds the liquid to the nozzles for ejection. In one type of inkjet technology, referred to as "thermal inkjet", a heating element, such as a resistor for example, rapidly heats a small volume of the liquid, forming a bubble which causes at least one drop of the liquid to be ejected. The electrical energy needed to operate the nozzles is typically connected to the die at a surface edge. However, since the ink feed slot extends completely through the die, the electrical traces carrying this energy are routed around the slot. The longer the length of a slot, the longer the electrical traces used to get the energy from one side of the slot to the other become. Comparatively long electrical traces on the die result in an electrical voltage drop, due to the parasitic resistance of the traces, that increases along the length of a trace, particularly for those traces that carry significant amounts of electrical current. In printheads having a height of more than about one inch, these voltage drops can become large enough to prevent the nozzles nearest to the electrical connection to the die, and/or the nozzles furthest from the electrical connection to the die, from operating in their allowable voltage range. If this occurs, the size of the drops ejected from different nozzles may vary, some nozzles may be unable to emit drops, and some nozzles may be damaged. All of these effects result in the quality of the printed output being degraded.

Referring now to the drawings, there is illustrated an embodiment of a printhead die in which electrical traces provide proper electrical power to the various nozzles of the die in order to produce print output of the desired quality. The die may provide an array of nozzles for emitting drops of a same liquid that is from one to four inches high, or more, along the major axis of the array. Such an array may sometimes be referred to as a "page wide" array, as a single die, or a small number of cooperating die, may be sufficient to print on the entire width of a print medium. The shaping and layout of the various components of the nozzle array on the printhead die minimize the width of the die while providing proper power distribution to all nozzles, thus advantageously reducing the cost of the printhead die.

As defined herein and in the appended claims, a "liquid" shall be broadly understood to mean a fluid not composed primarily of a gas or gases. In addition, terms of orientation and relative position (such as "top", "bottom", "side", "height", "width", "length", and the like) are not intended to require a particular orientation of any element or assembly, and are used for convenience of illustration and description.

As can be appreciated with reference to FIG. 1, one example of the printhead die 10 has a slot arrangement in which a full-length slot is segmented into smaller slots, which are then offset to form two parallel columns with alternating slot segments. In this regard, the die 10 has two substantially parallel columns 12, 14 of slot segments 20 (hereinafter also referred to as slots 20) that extend through the die 10 for feeding the same liquid. The substantially parallel slots 20 are staggered in alternating columns 12, 14. While two slots 20 are illustrated in each column for clarity, it is understood that each column may include a larger number of slots 20. Column 12 is offset from column 14 in the minor axis direction 4 of slots 20 by a slot-to-slot spacing 30. In some examples, the slot-to-slot spacing 30 may be around 1000 microns. It can be appreciated that the slot-to-slot spacing 30 affects the width 35 of the die 10. The width 35 is, in turn, proportional to the cost of the die 10.

Adjacent slots in different columns, such as slots 20*a*, 20*b*, are also offset from each other in the major axis direction 2 of the slots 20. Typically, the adjacent slots 20 in the alternate columns 12, 14 are arranged such that adjacent ends of the slots are positioned along the same minor axis. For example, the adjacent ends of slots 20*b*, 20*c* are along the same minor axis 32. Similarly, the adjacent ends of slots 20*a*, 20*b* are along the same minor axis, as are the adjacent ends of slots 20*c*, 20*d*, and so on. This positioning facilitates treating the nozzles associated with the slots 20 of both columns 12, 14 as a virtual linear array of nozzles of height 37 during printing operations, where the nozzles are equally spaced along the major axis 2. In some examples, the adjacent ends of slots 20*b*, 20*c* may overlap the minor axis 32 by a few nozzles in order to allow for compensation of effects such as misdirection of drops ejected from end nozzles or to provide sufficient liquid flow to the end nozzles. In such embodiments, ones of the overlapping nozzles that achieve the desired printing performance will be chosen for use during printing operations. Where the die 10 is a page wide array die, the height 37 of the array of slots 20 may be one to four inches, or even more.

Electrical power, as well as data and control signals, are connected to the printhead die 10 via pads 42. Each pad 42 is associated with an individual power connection, data signal, or control signal. Typically, at least one pad 42 is disposed on the die 10 between every two slots 20 in a particular column. For example, pad 42*a* is disposed in column 12 between slots 20*a*, 20*c*. From pads 42, traces 40 are run across the die 10 in the direction 4 of the minor axis. Since the slots 20 pass completely through the die 10, the traces are routed around the slots 20. The slot-to-slot spacing 30 is sufficient to allow, for example, trace 40*a* to pass between the lower end of slot 20*a* and the upper end of slot 20*b* so that it can be connected to electronics disposed on the side of slots 20*a*, 20*b* that are furthest from column 12. While not illustrated for reasons of clarity, it is understood that traces from pad 42*a* can also directly connect to electronics on the side of slots 20*a*, 20*b* that is nearest the column 12. It can be appreciated that, particularly in page wide arrays, the total length of trace 40*a* is considerably shorter than if, for example, slots 20 were all combined into a single slot of height 37. In that case, the trace 40*a* would be far longer, as it would be routed around the top or bottom end of the die to get to the electronics on the other side of the slot from the pad. In page wide arrays, and particularly for power traces that carry a significant amount of current, such as up to one ampere, this excessive distance would result in unacceptable voltage drops due to the parasitic resistance of the trace. However, according to the present example of the printhead die 10, the lengths of traces 40*a*, 40*b* are short enough to ensure that the voltages applied to all nozzles, regardless of location, are within tolerance. This, in turn, helps ensure that the size of the drops ejected from different nozzles is consistent, and that all nozzles are able to emit drops, which in turn helps ensure that the printed output is of high quality.

Figure 2:
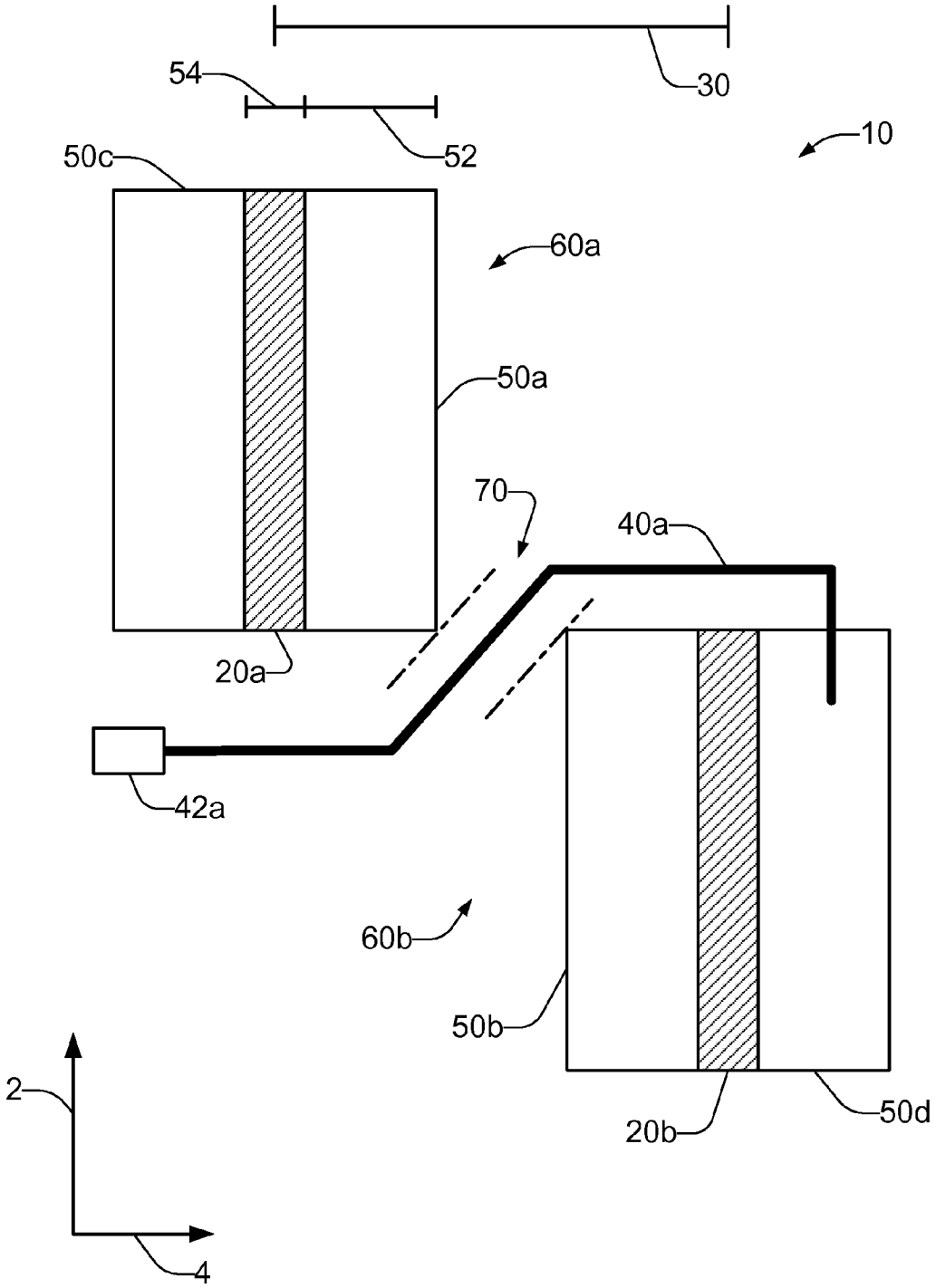
FIG. 2 is an enlarged schematic representation of a portion of the printhead die of FIG. 1 showing an end of adjacent nozzle packages in two columns, in accordance with an embodiment of the present disclosure.

Considering now in greater detail, and with reference to FIG. 2, a printhead die 10, according to an example of the present disclosure, the die 10 includes two adjacent slot clusters 60*a*, 60*b* in different columns. In each slot cluster 60*a*, 60*b*, a nozzle package 50 is disposed adjacent to, or abutting, each long side of a slot 20. Each nozzle package 50 is substantially rectangular, and has a height substantially the same as the slot height.

As defined herein and in the appended claims, a "nozzle package" shall be broadly understood to include a linear array of equally-spaced nozzles abutting or adjacent to, and substantially parallel to, a long side of a slot, such that the liquid fed through the slot can flow into each nozzle of the nozzle package for subsequent ejection. Each nozzle package shall also be understood to include electronics that receive power, data, and control signals that cause drops of the liquid to be controllably ejected from the individual nozzles. The power and signals are received by the electronics via traces which may be connected to signal source locations such as, for example, pads 42*a*. Each nozzle is associated with a portion of the electronics such as, for example, a drive circuit for the nozzle. A "slot cluster" shall be broadly understood to mean the arrangement of a slot and a nozzle package disposed abutting or adjacent to each long side of the slot.

In some examples, the width of each slot 20 in the direction 4 of the minor axis is about 150 microns. The length of each slot 20 in the direction 2 of the major axis may be about 15,000 to 30,000 microns. Thus the slot may have an aspect ratio of about 100 to 1, or greater. Consequently, a page wide printhead die in which the slots 20 collectively span a distance of approximately four inches in the direction 2 of the major axis has about four slots in each column 12, 14, for a total of eight slots. It will be appreciated that the drawings of FIGS. 1 through 6, accordingly, are, for purposes of clarity, not drawn to scale and do not show all of the slots.

In some examples, the width 52 of a nozzle package 50, including the nozzle array and the electronics, may be about 400 microns. A corresponding slot cluster 60*a*, 60*b* is thus about 950 microns wide. The slot-to-slot spacing 30 is based not just on the width 52 of a nozzle package 50*a*, 50*b*, however, but also on the width, in the minor axis direction 4, of the pathway 70 through which at least trace 40*a* is routed. In addition, although not shown for clarity, power may be provided to the electronics of nozzle package 50*a* via a trace that is coupled to trace 40*a*, or alternatively connected directly from pad 42*a*; such a trace could connect to the electronics of nozzle package 50*a* without being run through pathway 70.

The length and the width of trace 40*a*, in turn, depend not just on the width of the slot clusters, but also on the slot-to-slot spacing 30 between slots 20*a* and 20*b* in the direction of the minor axis 4. A longer trace 40*a* occurs with a larger spacing 30. With regard to the width of trace 40*a*, although one trace 40*a* and pad 42*a* are illustrated for clarity, it can be appreciated that a number of different traces for power, data, and/or control signals may run through pathway 70. The dimensions of pathway 70 are typically chosen to accommodate the number and the width of the traces that are routed through the pathway 70. Or, stated conversely, the dimensions of the pathway 70 may limit the number and/or the width of the traces that can be routed through the pathway 70. It will be appreciated that the width of power traces is typically considerably wider than that of data or signal traces, due to the larger amount of current carried by the power traces. The more and/or wider the traces that run through the pathway 70 are, the wider the pathway 70 itself. Because the adjacent ends of slots 20*a*, 20*b* are constrained to remain along the same minor axis 32 in order to maintain the equidistant spacing of nozzles in the direction 2 of the major axis between the bottom of slot 20*a* and the top of slot 20*b*, widening the pathway 70 is accomplished by increasing the slot-to-slot spacing 30, which in turn increases the width of the die 10 and increases its cost.

Figure 3:
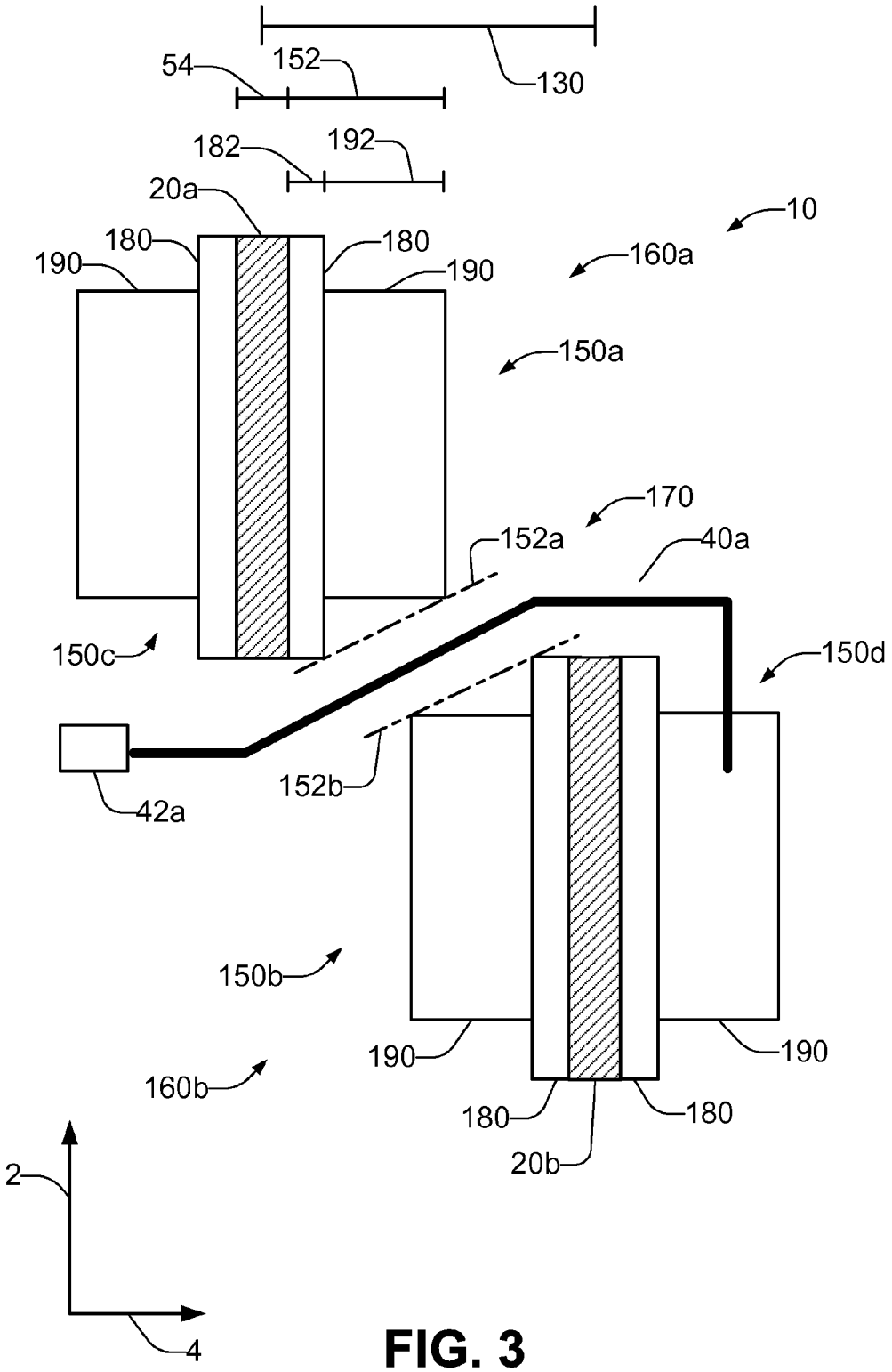
FIG. 3 is an enlarged schematic representation of a portion of the printhead die of FIG. 1 showing an end of adjacent nozzle packages in two columns, where the columns are closer together than in FIG. 2, in accordance with another embodiment of the present disclosure.

Considering now in greater detail, and with reference to FIG. 3, the structure of the printhead die 10 near two adjacent slot clusters 160*a*, 160*b* in different columns according to another example of the present disclosure, a nozzle package indicated generally at 150 is disposed adjacent to, or abutting, each long side of a slot 20. Nozzle package 150*a*, 150*c* are associated with slot 20*a*, while nozzle packages 150*b*, 150*d* are associated with slot 20*b*. However, unlike the rectangular shape of nozzle package 50, at least one nozzle package 150 has a slanted or angled corner profile 152 at least at one corner. In some examples, nozzle packages 150 have a slanted or angled corner profile 152 at the corners adjacent at least one end of a slot 20. As illustrated in FIG. 3, each nozzle package 150 has two slanted or angled corner profiles 152, such that the corners adjacent both ends of the slot 20—in other words, all four corners of a slot cluster 160—have the corner profile 152. The angled corner profile 152 of nozzle package 150 advantageously allows the slot-to-slot spacing 130 between the two slot clusters 160*a*, 160*b* to be reduced compared to the slot-to-slot spacing 30 of rectangular shape of nozzle package 50, while still providing a pathway 170 between the two slot clusters 160*a*, 160*b* for electrical traces, such as trace 40*a*, that has substantially the same width as pathway 70. The adjacent corner profiles 152*a*, 152*b* define the diagonal pathway 170 between the two slot clusters 160*a*, 160*b*.

Each nozzle package 150 includes a linear array 180 of equally-spaced nozzles abutting or adjacent to, and substantially parallel to, the slot 20, so that the liquid fed through the slot 20 can flow into each nozzle for subsequent ejection. The nozzle spacing in the direction of the major axis 2 is typically determined based on the printing resolution of the printhead, which is usually specified as the number of dots per inch (dpi). For example, assume that the printhead die 10 provides 600 dpi printing. Since a linear nozzle array 180 is disposed on each sides of a slot 20, each linear nozzle array 180 contains 300 nozzles per inch of length. Since the nozzles are equidistant, the spacing between nozzle centers in the direction of the major axis 2 is about 84.6 microns. 600 dpi printing resolution of the die 10 may be achieved by offsetting the nozzles in the array 180 on one side of the slot 20 in the direction of the major axis 2 by one-half of a nozzle spacing relative to the nozzles in the array 180 on the other side of the slot 20. The length of the nozzle array 180 in the direction of the major axis 2 may be substantially equal to the length of the slot 20. The width 182 of the nozzle array 180 in the direction of the minor axis 4 is about 100 microns. Since the bottom of at least one of the nozzle arrays 180 of slot cluster 160*a*, and the top of at least one of the nozzle arrays 180 of slot cluster 160*b*, are aligned along the same minor axis, the spacing between nozzle centers of the virtual 600 dpi linear array in the major axis 2 direction is maintained across the boundary between slot clusters 160*a*, 160*b*. In other words, the spacing, in the major axis direction 2, between the bottom nozzle in the nozzle arrays 180 of slot cluster 160*a*, and the top nozzle in the nozzle arrays 180 of slot cluster 160*b*, is the same spacing as between nozzles within an individual nozzle array 180.

Each nozzle package 150 also includes electronics 190 that receive power, data, and control signals that cause drops of the liquid to be controllably ejected from the individual nozzles via traces which may be connected to pad 42*a* or other signal source locations. Typically, each nozzle is associated with a portion of the electronics, such as a drive circuit for the nozzle. Traces (not shown) connect a drive circuit to the heater resistor (also called the "firing resistor") of its corresponding nozzle so that the liquid can be controllably heated and drops of the liquid ejected.

The form factor of the electronics 190 in a nozzle package 150 is organized such that the length of the electronics 190 in the major axis direction 2 is less than the length of the nozzle array 180 in the major axis direction 2. For example, the length in the major axis direction 2 of the corresponding drive circuit for each nozzle may be 60 microns, instead of the 84.6 micron nozzle-to-nozzle spacing, with the drive circuits packed adjacent or abutting each other in the major axis direction 2. As a result, the height of the electronics 190 along the major axis 2 may be reduced to approximately 70% of the height of the nozzle arrays 180. In some examples, the electronics 190 is substantially centered in the major axis direction with respect to the corresponding nozzle array 180.

This arrangement provides nozzle package 150*a* of slot cluster 160*a* with a slanted corner profile 152*a* that is defined, at least in part, by the closest point of the nozzle array 180 and electronics 190 of slot cluster 160*a* to slot cluster 160*b*. In some examples, the slanted corner profile 152 is the same for the two diagonally adjacent slot clusters 160*a*, 160*b*, and thus the corner profiles of the first and second nozzle packages have substantially parallel slants.

Reducing the height of the electronics 190 in the direction of the major axis 2 may be achieved by increasing the width 192 of the electronics 190 in the direction of the minor axis 4. For example, assuming that the electronics portion of nozzle package 50 (FIG. 2) is about 300 microns wide, the reduced-height electronics 190 would be about 425 microns wide. This increase in width results from reorganizing the geometry of the electronics to reduce its height, since the area occupied by the electronics is approximately the same in both nozzle package 50 and nozzle package 150. As a result, the width 152 of nozzle package 150 (including nozzle array 180 and electronics 190) would be about 525 microns, compared to 400 microns for nozzle package 50. Assuming a slot 20 width of 150 microns, the width of slot cluster 160 is about 1200 microns, compared to 950 microns for slot cluster 60. However, the slanted corner profiles 152*a*, 152*b* allow the slot-to-slot spacing 130 between the two slot clusters 160*a*, 160*b* to be significantly reduced compared to the slot-to-slot spacing 30 between rectangular slot clusters 60*a*, 60*b* (FIG. 2). As a result, while the slot-to-slot spacing 30 for a particular pathway 70 would be about 1200 microns, the slot-to-slot spacing 130 for a similar pathway 170 would be about 600 microns.

Figure 4:
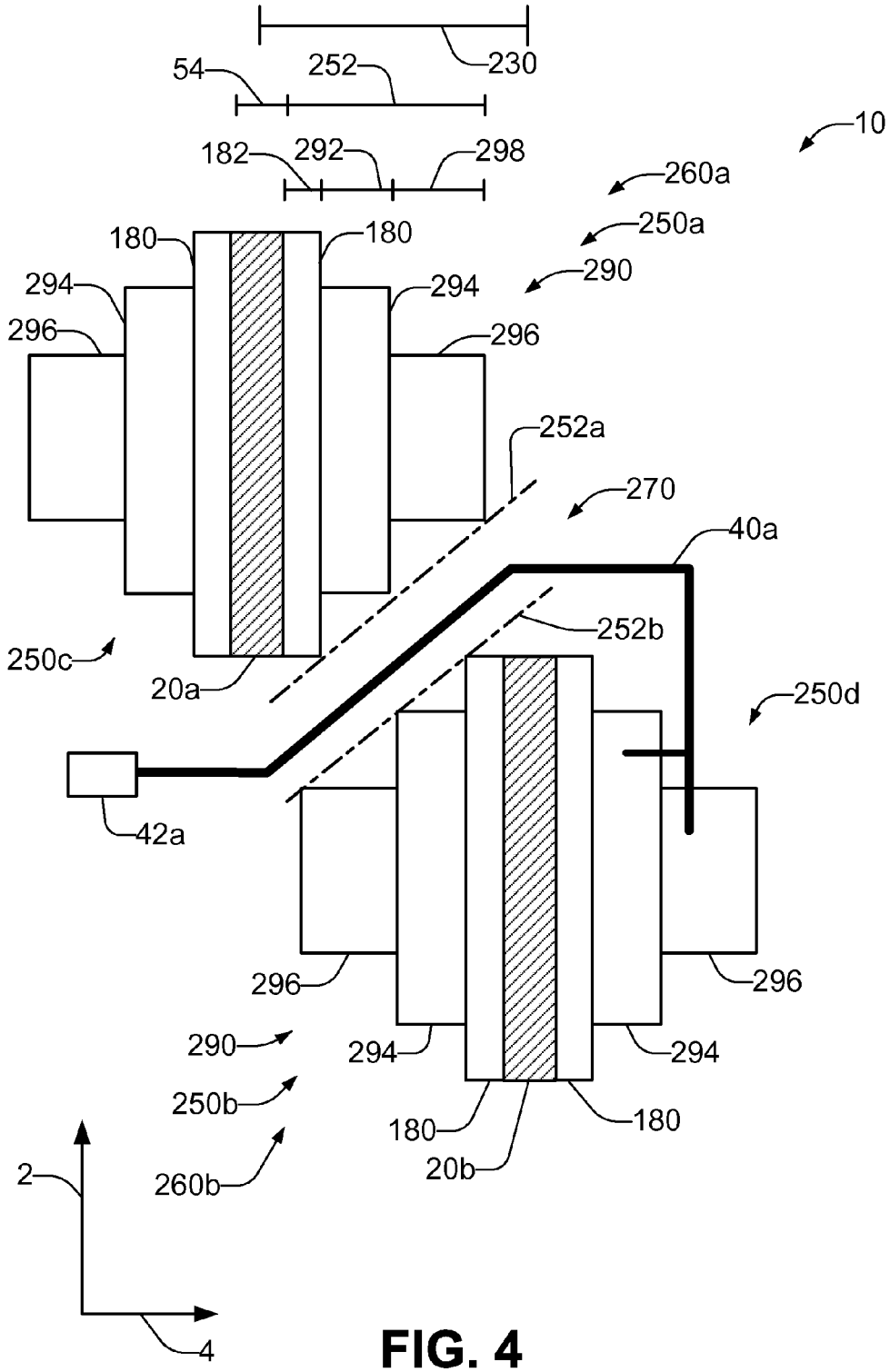
FIG. 4 is an enlarged schematic representation of a portion of the printhead die of FIG. 1 showing an end of adjacent nozzle packages in two columns, where the columns are closer together than in FIG. 3, in accordance with another embodiment of the present disclosure.

Considering now in greater detail, and with reference to FIG. 4, the structure of the printhead die 10 near two adjacent slot clusters 260*a*, 260*b* in different columns according to yet another example of the present disclosure, a nozzle package indicated generally at 250 is disposed adjacent to, or abutting, each long side of a slot 20. Nozzle package 250*a*, 250*c* are associated with slot 20*a*, while nozzle packages 250*b*, 250*d* are associated with slot 20*b*. At least one nozzle package 250 has a slanted or angled corner profile 252. In some examples, nozzle packages 250 have a slanted or angled corner profile 252 at the corners adjacent at least one end of a slot 20. As illustrated in FIG. 4, each nozzle package 250 has two slanted or angled corner profiles 252, such that the corners adjacent both ends of the slot 20—in other words, all four corners of a slot cluster 260—have the corner profile 252. The structure of nozzle package 250, with the angled corner profile 252, advantageously allows the slot-to-slot spacing 230 between the two slot clusters 260*a*, 260*b* to be reduced compared to the slot-to-slot spacing 130 achievable with nozzle package 150, while still providing a pathway 270 between the two slot clusters 260*a*, 260*b* for electrical traces, such as trace 40*a*. Pathway 270 has substantially the same width as pathway 170. Adjacent corner profiles 252*a*, 252*b* define the diagonal pathway 270 between the two slot clusters 260*a*, 260*b*.

Each nozzle package 250 includes a linear array 180 of equally-spaced nozzles abutting or adjacent to, and substantially parallel to, the slot 20, so that the liquid fed through the slot 20 can flow into each nozzle for subsequent ejection. The linear array 180 has been previously described in greater detail with reference to FIG. 3.

Each nozzle package 250 also includes electronics, indicated generally at 290, that receive power, data, and control signals that cause drops of the liquid to be controllably ejected from the individual nozzles via traces which may be connected to pad 42*a* or other signal source locations. The electronics 290 includes a drive switch array 294 disposed adjacent, or abutting, the linear nozzle array 180. Each nozzle in the linear array 180 is associated with a corresponding drive switch in the drive switch array 294. Typically, a power trace (also referred to as a "fire line") is connected to one side of the firing resistor of the nozzle, and the corresponding drive switch is connected to the other side of the firing resistor. The drive switch is also connected to a reference voltage (typically ground) trace. The drive switch controls the flow of current through the firing resistor. When the drive switch is turned on, current sufficient to heat the liquid and eject the drop from the nozzle flows from the power trace, through the firing resistor, to ground. In some examples, the drive switch is a field-effect transistor (FET) switch in which the firing resistor and ground are connected to the drain-source path of the FET, and the drive switch array is an array of such FETs.

The electronics 290 also includes a control logic array 296 disposed adjacent, or abutting, the drive switch array 294. The control logic array 296 receives data and control signals and determines whether and when drops of the liquid are ejected from a particular nozzle. In some examples, the data and control signals may also be routed through the pathway 270 in a manner similar to the power. An output from the control logic array 296 is connected to the control input of each drive switch, such as the gate of a FET switch. In some examples, the control logic array 296 includes about five to ten logic-type control transistors for each FET drive switch. However, these control transistors each typically occupy a smaller area than the FET drive switch.

The form factor of the electronics 290 is organized in a stair-step fashion. The length of the drive switch array 294 in the major axis direction 2 is less than the length of the nozzle array 180 in the direction of the major axis 2. Furthermore, the length of the control logic array 296 in the major axis 2 direction is less than the length of the drive switch array 294 in the major axis 2 direction. In one example, the length in the major axis direction 2 of the drive switch array 294 may be substantially the same as the length of electronics 190 (FIG. 3), which is about 70% of the height of the nozzle arrays 180. In another example, the length in the major axis direction 2 of the drive switch array 294 may be about 85% of the height of the nozzle arrays 180. The length in the major axis direction 2 of the control logic array 296 may be about 85% of the height of the drive switch array 294. In some examples, the drive switch array 294 and the control logic array 296 are substantially centered in the major axis direction with respect to the corresponding nozzle array 180. The stair-step organization may provide more efficient space utilization and reduced offset interconnections between drive switch elements, control logic elements, and individual nozzles of nozzle array 180 than the rectangular electronics arrangement 190 of FIG. 3.

This arrangement provides nozzle package 250*a* of slot cluster 260*a* with a slanted corner profile 252*a* that is defined, at least in part, by the closest point of its nozzle array 180, drive switch array 294, and control logic array 296 to slot cluster 260*b*. In some examples, the slanted corner profile 252 is the same for the two diagonally adjacent slot clusters 260*a*, 260*b*, and thus the corner profiles of the first and second nozzle packages have substantially parallel slants.

It can be appreciated that, in some examples, nozzle package 250 can be considered as having a generally triangular profile, with the nozzle array 180 considered as the base of the triangle. The drive switch array 294 forms a middle layer, and the control logic array 296 the uppermost layer.

The reduction in height of the drive switch array 294 and the control logic array 296 in the direction of the major axis 2 may be achieved by increasing the width 292 of the drive switch array 294 in the direction of the minor axis 4, and by increasing the width 298 of the control logic array 296 in the direction of the minor axis 4. For example, assuming that the electronics 190 (FIG. 3) is about 425 microns wide, the maximum width of the generally triangular electronics 290 would be about 500 microns wide. This increase in width results from reorganizing the geometry of the electronics to reduce its height in stair-step fashion, since the area occupied by the electronics 190, 290 is approximately the same. The width 292 of the drive switch array 294 would be about 220 microns, while the width 298 of the control logic array 296 would be about 280 microns. As a result, the width 252 of nozzle package 250 would be about 600 microns, compared to about 525 microns for the width 152 of nozzle package 150. Also, the width of slot cluster 260 is about 1350 microns wide, compared to about 1200 microns for slot cluster 160. However, the slanted or angled corner profiles 252*a*, 252*b* of the nozzle packages 250*a*, 250*b* allows the slot-to-slot spacing 230 between the two slot clusters 260*a*, 260*b* to be reduced compared to the slot-to-slot spacing 30 between slot clusters 60*a*, 60*b* (FIG. 2)

Figure 5:
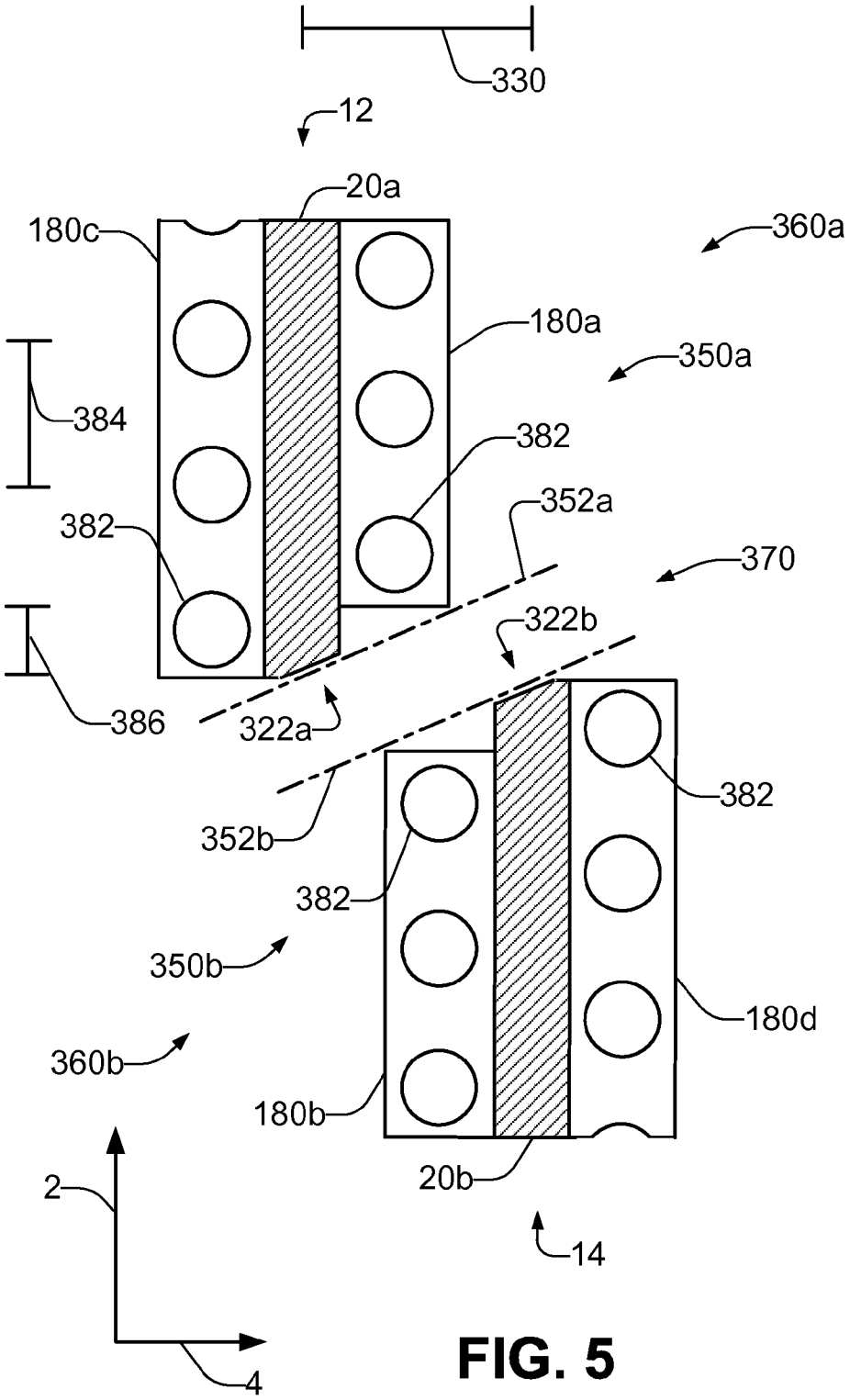
FIG. 5 is an enlarged schematic representation of a portion of the printhead die of FIG. 1 showing the shape of slot ends and positioning of nozzle arrays in two columns of adjacent nozzle packages, in accordance with an embodiment of the present disclosure.

Considering now in greater detail, and with reference to FIG. 5, the structure of adjacent slot clusters 360*a*, 360*b* according to a further example of the present disclosure, the geometry of slot ends and the relative positioning of the nozzle arrays 180 adjacent the slots 20 define a slanted or angled corner profile 352 of each slot cluster. FIG. 5 illustrates a portion of the lower end of slot cluster 360*a* encompassing six nozzles 382, and a portion of the upper end of slot cluster 360*b* encompassing 6 nozzles 382. While the nozzles 382 on each side of the slot 20 are illustrated as having the same position along the minor axis 4, in other examples the nozzles on a side have different positions along the minor axis 4. Staggering the nozzles along the minor axis 4 can allow for the firing time (i.e., the time at which the firing resistor of the nozzle is energized to eject a drop of the liquid) for different nozzles to be similarly staggered.

As described previously with reference to FIG. 3, the nozzles 382 in each linear nozzle array 180 have a certain nozzle density (i.e. nozzles per inch), and a corresponding equidistant spacing 384 between each two nozzles, that is related to the printing resolution of the die 10. Typically, the nozzle arrays adjacent or abutting both long sides of the slot 20 have the same nozzle density. Thus by offsetting the nozzles in the array 180 on one side of the slot 20 in the direction of the major axis 2 by one-half of a nozzle spacing relative to the nozzles in the array 180 on the other side of the slot 20, the printing resolution (i.e. dots per inch) of the printhead die becomes twice the nozzle density in each individual array 180.

One technique for offsetting the nozzles by one-half of a nozzle spacing includes offsetting the entire linear array 180 by one-half of a nozzle spacing in the major axis 2 direction. This, in turn, has the effect of shifting an end position of the array 180 by a distance 386 corresponding to one-half of the nozzle spacing 384. By choosing which of the two linear arrays 180 adjacent the slot 20 to offset based on the column 12, 14 in which the slot cluster 360 is located, the slot-to-slot distance 330 can be reduced.

As illustrated in FIG. 5, slot cluster 360*a* is in the leftmost column 12. Slot cluster 360*a* includes nozzle package 350*a*, which is disposed on the right side of slot 20*a*. Nozzle array 180*a* of nozzle package 350*a* is offset along the major axis 2 in an upward direction away from slot cluster 360*b* in the rightmost column 14. Slot cluster 360*b* includes nozzle package 350*b*, which is disposed on the left side of slot 20*b*. Nozzle array 180*b* of nozzle package 350*b* is offset along the major axis 2 in a downward direction away from slot cluster 360*a*. It can be appreciated that the length of each nozzle array 180 along the major axis 2 is shorter than a maximum length of a slot 20 by substantially the distance 386 corresponding to one-half of nozzle spacing 384.

In some examples, nozzle arrays 180*c*, 180*d* may have a length along the major axis 2 that is the same as the slot length. In other examples, where nozzle arrays 180*c*, 180*d* have the same length along the major axis 2 as arrays 180*a*, 180*b*, nozzle array 180*c* is offset along the major axis 2 in the opposite direction from nozzle array 180*a*, and nozzle array 180*d* is offset along the major axis 2 in the opposite direction from nozzle array 180*b*.

In some examples, the slots 20 may also be slanted or angled at an end. The lower end of slot 20*a* has a slanted end 322*a*, while the upper end of slot 20*b* has a complementary slanted end 322*b*. The slant of end 322*a* shortens the side of slot 20*a* that is adjacent, or abutting, the offset nozzle array 180*a*, while the slant of end 322*b* shortens the side of slot 20*b* that is adjacent, or abutting, the offset nozzle array 180*b*. The slant typically is not brought to a point, but rather has a degree of rounding sufficient to reduce the risk of fracture. In some examples, a slot 20 is slanted at one end.

The offsetting of nozzle arrays 180*a*, 180*b*, and/or the slanting of slot ends 322*a*, 322*b*, result in slanted or angled corner profiles 352*a*, 352*b* for the nozzle packages 350*a*, 350*b* respectively. The corner profiles 352*a*, 352*b* define a pathway 370 for electrical circuit traces between nozzle packages 350*a*, 350*b* (and thus between slot clusters 360*a*, 360*b*) at a reduced slot-to-slot spacing 330. It is apparent from FIG. 5 that, without the offsetting of nozzle arrays 180*a*, 180*b*, there would be no pathway between slot clusters 360*a*, 360*b* unless the slot-to-slot spacing 330 were to be increased. In some examples, the offsetting of nozzle arrays 180*a*, 180*b*, and/or the slanting of slot ends 322*a*, 322*b*, allows an increased width of pathway 370 of about 50 microns for the same slot-to-slot spacing 330. The offsetting of nozzle arrays 180*a*, 180*b*, and/or the slanting of slot ends 322*a*, 322*b*, can be used independently of, or in addition to, the slanted or angled corner geometries of FIGS. 3 and 4.

Figure 6:
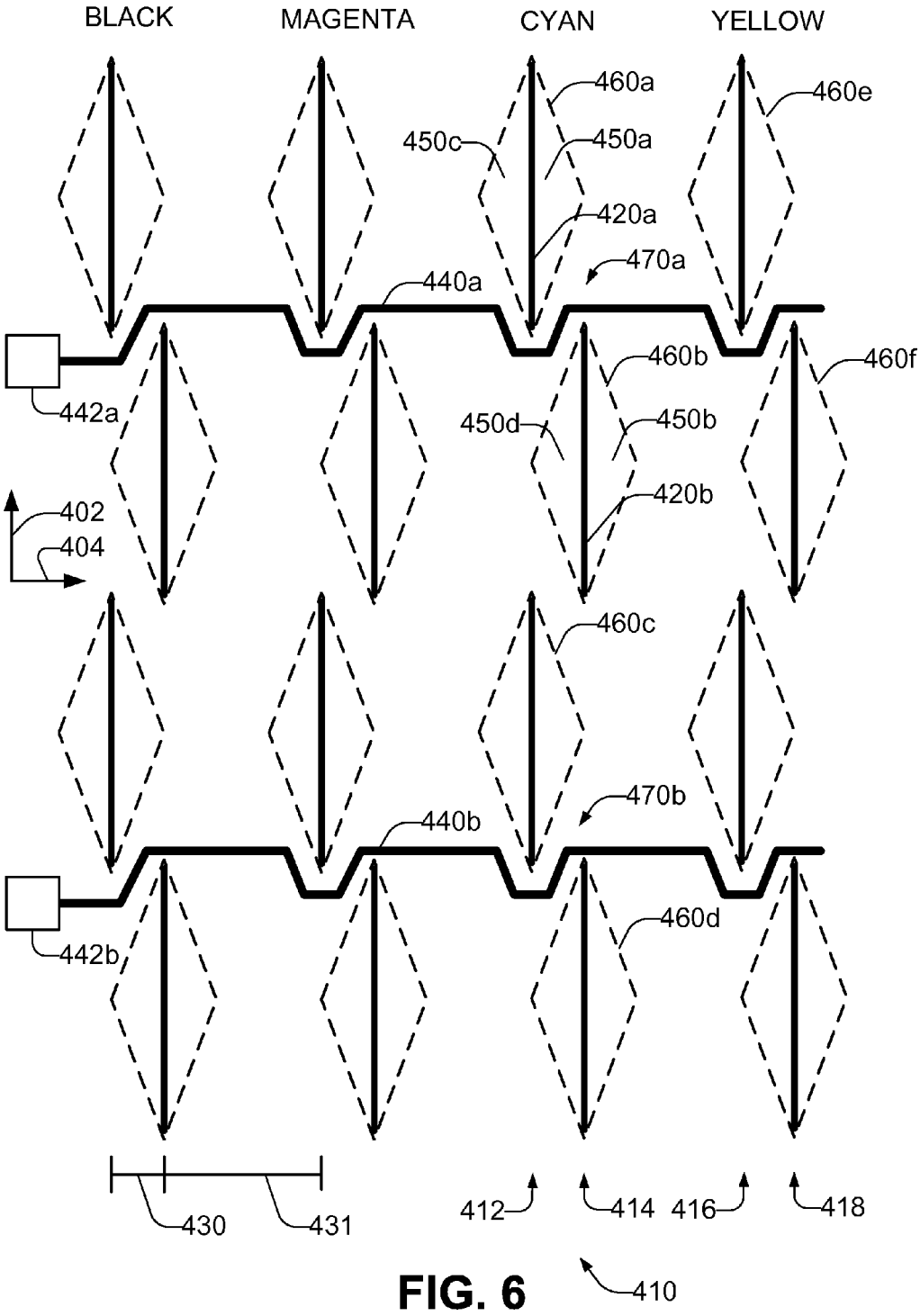
FIG. 6 is a schematic representation of a printhead die for emitting drops of a plurality of different liquids, in accordance with another embodiment of the present disclosure.

Considering now a printhead die for emitting drops of a plurality of different liquids in accordance with another example of the present disclosure, and with reference to FIG. 6, the die may be a rectangular page wide array printhead die 410. The die 410 includes an arrangement of generally trapezoidal printhead slot clusters 460. In other words, the profile of each slot cluster 460 is generally trapezoidal. Each trapezoidal grouping 460 has a liquid feed slot 420 that substantially bisects the trapezoidal grouping 460 in a bisecting direction 402. Each trapezoidal grouping 460 has a generally triangular nozzle package 450 adjacent, or abutting, each side of the liquid feed slot 420. In other words, the profile of each nozzle package 450 is generally triangular. One example of a generally triangular nozzle package 450 may comprise a nozzle array 180 and electronics 190 as described with reference to FIG. 3. Another example of a generally triangular nozzle package 450 may comprise a nozzle array 180, drive switch array 294, and control logic array 296 as described with reference to FIG. 4. The base of the triangle of nozzle package 450 is disposed adjacent the slot 420 along the bisecting direction 402.

Trapezoidal groupings for a given liquid—such as, for example, a liquid of a particular color—are staggered in two alternating columns 412, 414 in the bisecting direction. The die 410 has a diagonal circuit pathway 470*a* between a first trapezoidal grouping 460*a* for the given liquid in the first column 412 and an adjacent second trapezoidal grouping 460*b* for the given liquid in the second column 414. A power trace 440*a* can be routed from a location in the first column (i.e. a location in the first column between the first trapezoidal grouping 460*a* and a third trapezoidal grouping 460*c*), through the circuit pathway 470*a*, and connect to the nozzle package 450*b* of the second trapezoidal grouping 460*b* disposed on the opposite side of the liquid feed slot 420*b* from the location. The first trapezoidal grouping 460*a* in the first column 412 and the second trapezoidal grouping 460*b* in the second column 414 overlap in the bisecting direction 402. This overlap reduces the slot-to-slot spacing 430 between slot clusters 460 for the same liquid in adjacent columns 412, 414. The power trace 440 may also connect to one or more of the nozzle package 450*a*, 450*c*, 450*d*.

In some examples, two alternating columns 416, 418 of trapezoidal groupings 460*e*, 460*f* for a second liquid (e.g. yellow ink), different from the given liquid for trapezoidal groupings 460*a*, 460*b* (e.g. cyan ink), are spaced apart, in a direction 404 orthogonal to the bisecting direction 402, from the two alternating columns 412, 414 for the given liquid. The slot-to-slot spacing 431 between slot clusters 460 for two different liquids in adjacent columns, such as columns 414, 416, may be considerably greater than the slot-to-slot spacing 430 between slot clusters 460 for the same liquid in adjacent columns 412, 414. The spacing 431 is typically related to the size of the physical barriers, such as vertical ribs, between columns 414, 416 that are attached to the back side of the die 410 to keep the two different liquids separated from each other.

In some examples, the trapezoidal slot clusters 460 are arranged on the die 410 in rows and columns. Each pair of adjacent columns is associated with a different liquid. For example, columns 412, 414 are associated with cyan ink, while columns 416, 418 are associated with yellow ink.

Each slot cluster 460 is assigned to a particular row. In some examples, a power trace 440 is routed across the die 410 in the row direction 404 in-between two rows of slot clusters 460. For example, power trace 440*a* passes in a serpentine manner through a diagonal passageway 470*a* between a slot cluster 460*a*, 460*e* in one row and a slot cluster 460*b*, 460*f* in the other row. Typically, a power trace 440 is routed between every other adjacent pair of rows. For example, power trace 440*b* passes in a serpentine manner through a diagonal passageway 470*b* between a slot cluster 460*c* in one row and a slot cluster 460*d* in the other row. A pad 442 for a power trace may be disposed at or near a vertical edge of the die 410. For example, pad 442*a* is connected to power trace 440*a*, while pad 442*b* is connected to power trace 440*b*. While power traces 440 are illustrated as going across the die, it is understood that some traces are routed, or tapped off, to connect to the electronics of different ones of the slot clusters 460 in the row above or below the trace.

Figure 7:
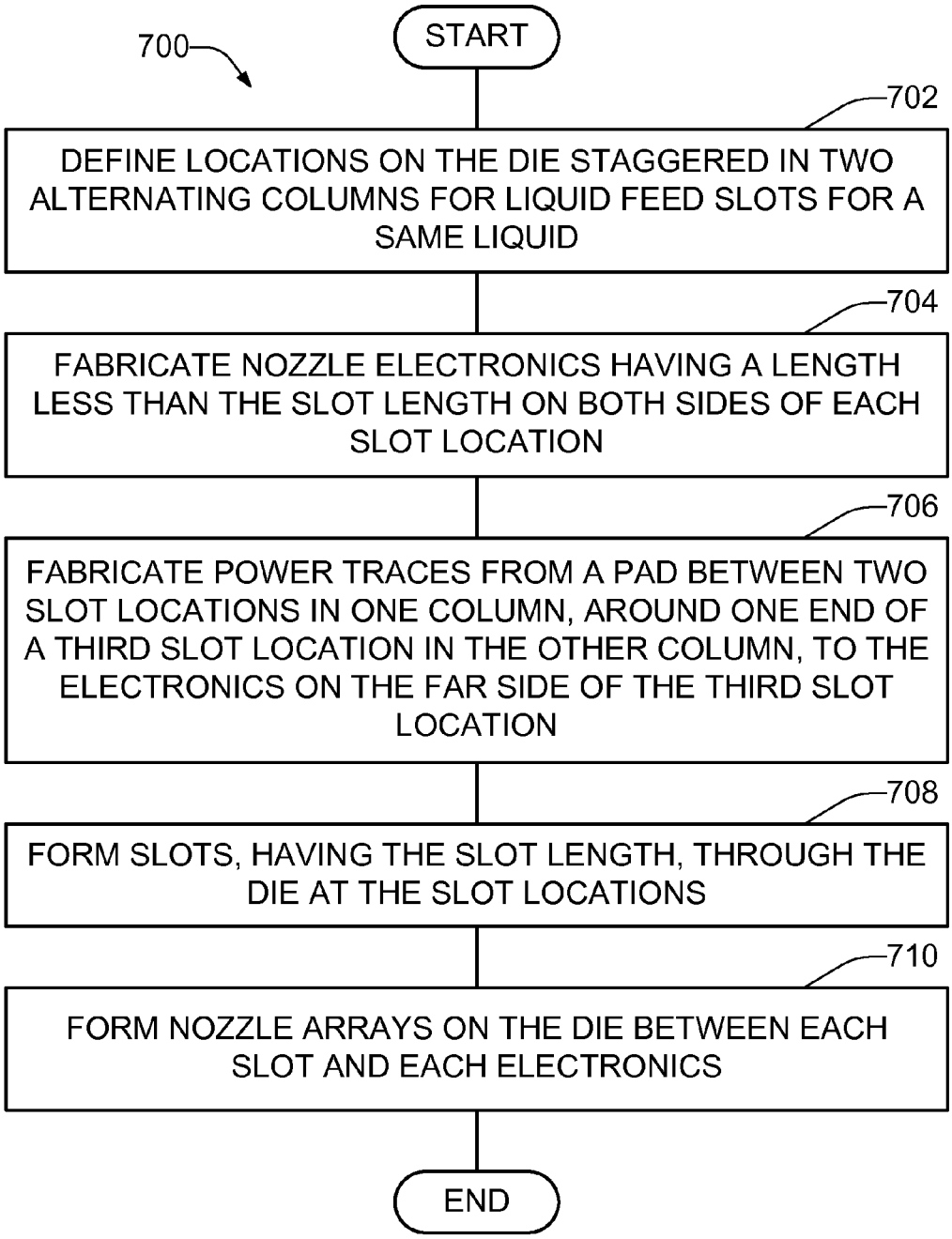
FIG. 7 is a flowchart according to an embodiment of the present disclosure of a method of making a printhead die.

Considering now a method 700 for making a page wide array silicon printhead die in accordance with an example of the present disclosure, and with reference to FIG. 7, at 702, locations for liquid feed slots for a same liquid, staggered in two alternating columns, are defined on the die. Each slot has a length along a common major axis.

At 704, nozzle electronics having a length less than the slot length are fabricated on one or both sides of each slot location. The electronics can be fabricated on the die by integrated circuit processing techniques such as a standard NMOS or CMOS silicon fabrication process. The electronics are configured to control ejection of drops of the same liquid from a linear array of nozzles. The electronics have a second length in the direction of the major axis that is less than the slot length.

At 706, traces, including one or more power traces, are fabricated from a source point, such as a pad, between two adjacent slot locations in one column, around one end of a third slot location in the other column, to the electronics on the far side of the third slot location. The traces can be fabricated on the die using integrated circuit processing techniques the same or similar to those for the electronics.

At 708, slots, each having the slot length, are formed through the die at each of the slot locations. The slots can be formed through the die by techniques such as laser drilling. A slant can be formed at an end of a slot by laser drilling, among other techniques. Since laser drilling removes a 20 micron section at a time, the corner of the slot can be tapered in 20 micron increments. The slot is typically formed after the electronics and the traces have been fabricated.

At 710, nozzle arrays are formed on the die between each slot and each electronics. A nozzle array has a third length greater than the second length of the electronics, and less than or equal to the slot length. In general, there are two parts to a nozzle array: the firing resistors, and the orifice layer that defines the chambers in which the firing resistors are disposed. The firing resistors are fabricated using integrated circuit processing techniques, such as NMOS or CMOS techniques. In some examples the orifice layer is a metal orifice layer that is attached to the die. In other examples the orifice layer is an SU8 MEMS-type orifice layer formed using semiconductor processing techniques such as patterning and etching. In some examples, the firing resistors may be formed before slot formation, while the orifice layer is formed after slot formation.

In some examples, a number of dice may be fabricated on a single silicon wafer, from which an individual die is cut or separated.

From the foregoing it will be appreciated that the printhead dies and methods provided by the present disclosure represent a significant advance in the art. A die having slot clusters fabricated with a slanted corner profile, offset linear nozzle arrays, and slanted slot ends as described with reference to FIGS. 3-5 can achieve about a 2:1 reduction in slot-to-slot distance for the intra-color slots (i.e. slots for the same liquid), and about a 3:2 reduction in overall die width when the mechanically-fixed inter-color slot spacing is accounted for, compared to rectangular slot clusters as described with reference to FIG. 2. Such a die can also achieve about a 3:2 reduction in die cost, compared to rectangular slot clusters as described with reference to FIG. 2.

Although several specific examples have been described and illustrated, the disclosure is not limited to the specific methods, forms, or arrangements of parts so described and illustrated. For example, while the generally triangular profile of the nozzle packages may be formed, for example by successively shorter rectangular layers of a nozzle array, drive switch array, and control logic array, in other examples some or all of these layers may be trapezoidal instead of rectangular, having a slanted or angled side that is substantially similar to the overall slant or angle or the corner profile of the nozzle packages. This description should be understood to include all novel and non-obvious combinations of elements described herein, and claims may be presented in this or a later application to any novel and non-obvious combination of these elements. The foregoing examples are illustrative, and no single feature or element is essential to all possible combinations that may be claimed in this or a later application. Unless otherwise specified, steps of a method claim need not be performed in the order specified. The disclosure is not limited to the above-described implementations, but instead is defined by the appended claims in light of their full scope of equivalents. Where the claims recite "a" or "a first" element of the equivalent thereof, such claims should be understood to include incorporation of one or more such elements, neither requiring nor excluding two or more such elements.

What is claimed is:

1. A printhead die, comprising:

first and second parallel slots through the die for feeding a same liquid, the slots offset from each other in the direction of a major slot axis and an orthogonal minor slot axis;

a first nozzle package adjacent one long side of the first slot and extending toward the second slot along the minor axis;

a second nozzle package adjacent an opposite long side of the second slot and extending toward the first slot along the minor axis, the first and second nozzle packages each having a slanted corner profile that defines a diagonal circuit pathway between the packages.

2. The printhead die of claim 1, wherein each of the nozzle packages comprises:

a nozzle array having a side of a first length adjacent the long side of the slot; and electronics having a side of a second length adjacent an opposite side of the nozzle array, the second length shorter than the first length.

3. The printhead die of claim 2, wherein the electronics comprises a drive switch array having a side of the second length adjacent an opposite side of the nozzle array; and a control logic array having a side of a third length adjacent an opposite side of the drive switch array, the third length shorter than the second length.

4. The printhead die of claim 1, comprising:

a power trace routed across the die through the diagonal circuit pathway.

5. The printhead die of claim 1, wherein the corner profiles of the first and second nozzle packages have substantially parallel slants.

6. The printhead die of claim 1, wherein the slanted corners of the first and second nozzle packages enable closer placement of the packages along the minor axis than rectangular corners.

7. The printhead die of claim 1, wherein nozzles in the first and second nozzle packages have a uniform spacing therebetween in the direction of the major axis, and wherein an end nozzle in the first nozzle package and an end nozzle in the second nozzle package have the uniform spacing therebetween in the direction of the major axis.

8. The printhead die of claim 1, wherein the nozzle packages have a package length, adjacent the long side of the corresponding slot, that is shorter than a length of the slot, and wherein the first and second nozzle packages are each offset along the major axis in a direction away from the other nozzle package.

9. The printhead die of claim 1, wherein the first and second slots each have a slanted corner at a slot end adjacent the slanted corner of the first and second nozzle packages, the slanted corner of the slots having generally the same orientation as the slanted corner profile of the nozzle packages.

10. A printhead die, comprising:

an arrangement of generally trapezoidal printhead slot clusters, each trapezoidal slot cluster having a liquid feed slot substantially bisecting the trapezoidal slot cluster, and a generally triangular nozzle package adjacent a side of the liquid feed slot, the base of the triangle adjacent the slot along the bisecting direction; and wherein the trapezoidal slot clusters for a given liquid are staggered in two alternating columns in the bisecting direction.

11. The die of claim 10, comprising:

a diagonal circuit pathway between a first trapezoidal slot cluster for the given liquid in a first column and an adjacent second trapezoidal slot cluster for the given liquid in a second column.

12. The die of claim 11, comprising:

a power trace routed from a location between the first trapezoidal slot cluster and a third trapezoidal slot cluster in the first column through the circuit pathway to the nozzle package of the second trapezoidal slot cluster, the nozzle package disposed on the opposite side of the liquid feed slot from the location.

13. The die of claim 11, wherein two alternating columns of trapezoidal slot clusters for a second liquid, different from the given liquid, are spaced apart, in a direction orthogonal to the bisecting direction, from the two alternating columns for the given liquid.

14. The die of claim 10, wherein each generally triangular nozzle package comprises:

a nozzle array adjacent the side of the liquid feed slot, the nozzle array having one side adjacent the slot and a first length in the bisecting direction, and an electronics arrangement adjacent an opposite side of each nozzle array, each electronics arrangement having a second length in the bisecting direction shorter than the first length.

15. The die of claim 14, wherein the electronics arrangement comprises a drive switch array having a side of the second length adjacent an opposite side of the nozzle array; and a control logic array having a side of a third length adjacent an opposite side of the drive switch array, the third length shorter than the second length.

16. The die of claim 10, wherein the arrangement of the trapezoidal slot clusters is in rows and columns, each pair of adjacent columns associated with a different one of a plurality of liquids, and each slot cluster assigned to a row.

17. The die of claim 16, wherein a power trace is routed across the die in the row direction in-between two rows of slot clusters, the power trace passing in a serpentine manner through a first diagonal passageway between a slot cluster in one row and a slot cluster in the other row.

18. A method of making a printhead die, comprising:

defining locations on the die, staggered in two alternating columns, for a plurality of liquid feed slots for a same liquid, each slot having a length along a common major axis;

fabricating, on both sides of each slot location, electronics to control a linear array of nozzles, the electronics having a second length in the direction of the major axis less than the slot length; and fabricating a power trace from a source point between two adjacent slot locations in one of the columns, around one end of a third slot location in the other of the columns, to the electronics on the far side of the third slot location.

19. The method of claim 18, comprising:

forming, at each slot location, a slot through the die, each slot having the slot length.

20. The method of claim 19, comprising:

forming on the die, on both sides of each slot location, the nozzle array between the slot location and the electronics, the nozzle array having a third length greater than the second length and less than or equal to the slot length.

* * * * *